US005731030A

United States Patent [19]

Friese et al.

[11] Patent Number: 5,731,030

[45] Date of Patent: Mar. 24, 1998

[54] METHOD OF DETERMINING THE TRANSFERRED LAYER MASS DURING THERMAL SPRAYING METHODS

[75] Inventors: Karl-Hermann Friese, Leonberg; Peter Jansing, Renningen; Harry Braun, Heimsheim; Walter Bauer, Eberdingen; Marc Weller, Gerlingen; Thomas Kanz, Leonberg, all of Germany

[73] Assignee: Robert Bosch GmbH, Stuttgart, Germany

[21] Appl. No.: 717,346

[22] Filed: Sep. 20, 1996

[30] Foreign Application Priority Data

Sep. 21, 1995 [DE] Germany ..... 195 35 078.2

[51] Int. Cl.[6] ..... C23C 4/12; B05D 1/08

[52] U.S. Cl. ..... 427/8; 427/446; 427/449

[58] Field of Search ..... 427/8, 453, 455, 427/456, 446, 449

[56] References Cited

U.S. PATENT DOCUMENTS

| | | | |
|---|---|---|---|
| 4,505,945 | 3/1985 | Dubust et al. | 427/446 |
| 4,588,607 | 5/1986 | Matarese et al. | 427/455 |
| 4,897,283 | 1/1990 | Kumar et al. | 427/455 |

*Primary Examiner*—Katherine A. Bareford
*Attorney, Agent, or Firm*—Spencer & Frank

[57] ABSTRACT

A method of monitoring and controlling thermal spraying methods for coating the surface of substrates. During the spraying process, a substrate surface temperature is measured as a characteristic variable for the transferred layer mass or layer thickness, and, in the event of deviations from the nominal value, at least one method parameter that is significant for the transferred layer mass or layer thickness is changed. The method permits the creation of layers having a predetermined transferred layer mass or layer thickness and a narrow layer thickness distribution over the coated surface.

14 Claims, 2 Drawing Sheets

METHOD OF DETERMINING THE TRANSFERRED LAYER MASS DURING THERMAL SPRAYING METHODS

CROSS-REFERENCE TO RELATED APPLICATION

This application claims the priority of patent application Ser. No. 195 35 078.2, filed Sept. 21, 1995, in the Federal Republic of Germany.

BACKGROUND OF THE INVENTION

A number of different substrates can be provided with different inorganic coatings in thermal spraying methods. Plasma-spraying methods, flame-spraying methods and electric-arc spraying methods are included among thermal spraying methods. A feature common to all of the methods is that highly heated, inorganic particles are used as a coating material. A significant difference lies in the way in which the particles are heated. In the electric-arc spraying method, an electrical direct current or alternating current forms an arc between two continuously-advanced, wire-shaped fusible electrodes. The melted-off, heated material is directed as a particle beam or stream onto the substrate to be coated by means of a compressed-air flow. In a conventional embodiment of the flame-spraying method, a compressed-air flow draws the coating material, in the form of a pre-formed powder-air cloud, by suction, and permits it to exit as a particle stream from a central exit pipe of the burner in the direction of the substrate to be coated. Acetylene that mixes with the powder-particle flow outside of the burner, and produces the heat necessary for heating the particles during burning, exits an annular pipe coaxial to the exit pipe.

Plasma-spraying methods are being employed more and more frequently in coating technology. In a conventional embodiment, the coating materials are conveyed, as a fine powder, by an inert carrier gas such as argon into the plasma zone of a plasma burner, in which the particles are heated to a high temperature and melt, at least on their top surfaces. The plasma, a highly heated, ionized gas, is produced by means of an electrical arc from a burner gas, for example, a mixture of argon and nitrogen, and possibly other inert gases, such as helium. Temperatures can reach 30,000 K in the plasma zone. The plasma stream containing the coating material particles, which are melted on, at least on their surfaces, exits the burner and is directed onto the substrate to be coated, which is purposefully cooled by a cooling-gas flow. The particles form a porous or compact layer on the surface of the cooled substrate.

In many applications of thermal spraying methods, it is desirable to produce coatings whose thickness is defined and as uniform as possible over the coated surface. The transferred layer mass or the layer thickness and the layer thickness distribution depend on a considerably large number of parameters, among them the mass flow of the particles of the coating material in the particle beam, the relative speed at which the particle stream and the part to be coated move with respect to one another, and the number of individual spray passes, which together produce the desired layer thickness. "Relative speed" means that the burner can be stationary and the substrate can move, the substrate can be stationary and the burner can move, or both the burner and the substrate can move.

Particularly in the coating of parts in mass production, it would be desirable to be able to determine the transferred layer mass or the layer thickness and its distribution over the surface, so that, in the event of deviations from the desired values, control measures can be taken immediately, i.e., with the next part or at least with one of the next parts. No methods of directly determining the transferred layer mass or layer thickness during the spraying process are known that could be used in practice, however. A difference in weight in a part before and after coating, from which at least an average layer thickness could be calculated, is costly and, at least with short cycle times, does not permit a controlling correction by the time of the next spraying process or one of the next spraying processes.

SUMMARY OF THE INVENTION

In the method of the invention, a variable that can be determined easily and reliably, namely a surface temperature of the substrate during the spraying process, is monitored and used for controlling the transmitted layer mass or layer thickness. The method offers numerous economical advantages. The control intervenes quickly, which is especially important for coating parts in mass production involving short cycle times. Defective coatings that lead to rejected parts are already identified during the spraying process. Deviations from the desired transferred layer mass or layer thickness can be corrected immediately, that is, by the time of the next spraying process or at least one of the next spraying processes, by changing at least one definitive parameter. In parts that are coated in a plurality of passes, and in parts having large surfaces, control measures can already be taken during the spraying process. In this way, a uniform coating is produced that possesses the desired narrow layer mass distribution over the coated surface, and the rejection rate is kept low. The method is advantageous for mass production supported by assembly robots, because the above-mentioned reduction in the rejection rate is achieved, without monitoring, by a worker. Not only is a narrow layer mass distribution achieved in each individual part but also a high degree of constancy is achieved with respect to the transferred layer masses, layer thicknesses and narrow layer mass distributions in the individual parts within a series. It is also possible to provide an automatic production shutoff for times when the control options are not sufficient to assure operation according to specifications, for example if the cooling-gas flow fails.

BRIEF DESCRIPTION OF THE DRAWINGS

These and other features and advantages of the invention will be further understood from the following detailed description of the preferred embodiments with reference to the accompanying drawings in which.

DETAILED DESCRIPTION OF THE PREFERRED EMBODIMENTS

The methods according to the present invention can be employed in connection with the above-described thermal spraying methods. They are particularly suited for monitoring and controlling plasma-spraying methods. Various coating materials, such as metals and metal alloys, oxides or mixed oxides and high-fusion carbides, can be applied to substrates in thermal spraying methods. The substrates can also be made of metals or metal alloys, materials comprising oxides or mixed oxides, or sufficiently high-fusion, organic plastics. The selection of the suitable combination of coating material and substrate is familiar to a person skilled in the art. The methods of the invention can be used, for example, to coat thermally highly-stressed metallic parts having a layer of high-fusion oxides, as is necessary in some aircraft and spacecraft. When they are used to coat printing rollers, the outlay for grinding in the subsequent polishing process decreases due to the narrower layer thickness distribution.

The methods according to the invention have proven particularly successful in plasma-spraying methods for coating parts in mass production involving short cycle times, for example, oxygen sensors for internal combustion engines. In this instance, electrodes having a catalytic effect, for example, cermet composite electrodes comprising platinum and ceramic materials, are provided with a porous protection and diffusion layer of non-conductive and, for the most part, oxidic materials such as spinel, which is a magnesium aluminate.

Figure 1:
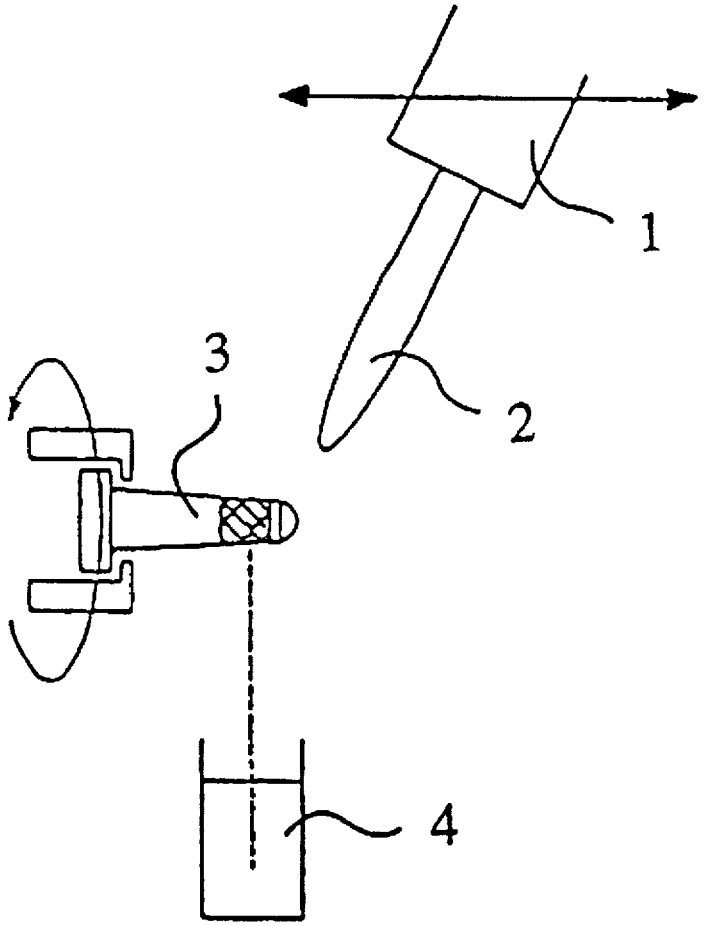
FIG. 1 schematically shows an arrangement for coating substrates in accordance with the plasma-spraying method.

FIG. 1 schematically shows an arrangement for coating oxygen sensors in accordance with the plasma-spraying method, including monitoring and control according to the present invention. The plasma burner 1 having a powder sprayer (not shown), which in this example is movable along a horizontal path, as indicated by the double-headed arrow, directs its particle stream 2 containing highly heated spinel particles onto the rotating oxygen sensor 3, whose axis of rotation is disposed in a horizontal position parallel to the above-mentioned horizontal path along which the plasma burner 1 moves. A cooling-gas flow that cools the oxygen sensor 3 is not shown. At specific, predetermined times, the radiation pyrometer 4 measures the temperature that dominates at a specific location on the surface of the sensor 3. The comparator that compares the measured values to a predetermined nominal value that has already been ascertained empirically is not shown, neither are the apparatuses and circuits by means of which at least one significant method parameter is appropriately altered when the measured values deviate from the nominal value.

An essential feature of the present invention is that, during the spraying process, a substrate surface temperature is measured as a characteristic variable for the transferred layer mass or layer thickness and, in the event of deviation from the nominal value, at least one significant method parameter that is decisive for the transferred layer mass or the layer thickness is changed for control purposes. The surface temperature must always be measured at a specific location and at a specific time after a spraying process (or after a pass if the spraying process involves a plurality of passes). The known contactless radiation pyrometers whose measuring ranges are matched to the anticipated surface temperatures are particularly suited for measuring. Infrared pyrometers having measuring ranges of 50° to 450° C. are advisably used to coat oxygen sensors. The measuring spot, that is, the surface whose temperature is measured, can have an arbitrary shape and, depending on the coating job, can be smaller or larger. Circular measuring spots having, for example, a 5 mm diameter have proven suitable for coating oxygen sensors.

The present invention is based on the observation that a substrate surface temperature measured at a specific location and at a specific time is a usable characteristic variable for the transferred layer mass or the attained layer thickness. A virtually linear relationship exists over large segments between the transferred layer mass and the surface temperature. This applies with the prerequisite that the parameters that are significant for the transferred layer mass or layer thickness are sufficiently constant. In plasma-spraying methods, parameters include the voltage and the current intensity with which the plasma burner are operated; the mass flow of the coating material in particle form, that is, the quantity of powder supplied per unit of time; the gas volume flow, that is, the volume per time unit of the inert carrier gas, such as argon, of the burner gas, such as argon and nitrogen; and that of another inert gas with respect to the coating material and the substrate, such as helium, that may also be used under the method conditions. Moreover, the cooling-gas flow directed at the substrate is included, in terms of direction and intensity, as one of the parameters that must be sufficiently constant for a virtually linear relationship to exist between the layer mass and the surface temperature.

Figure 2:
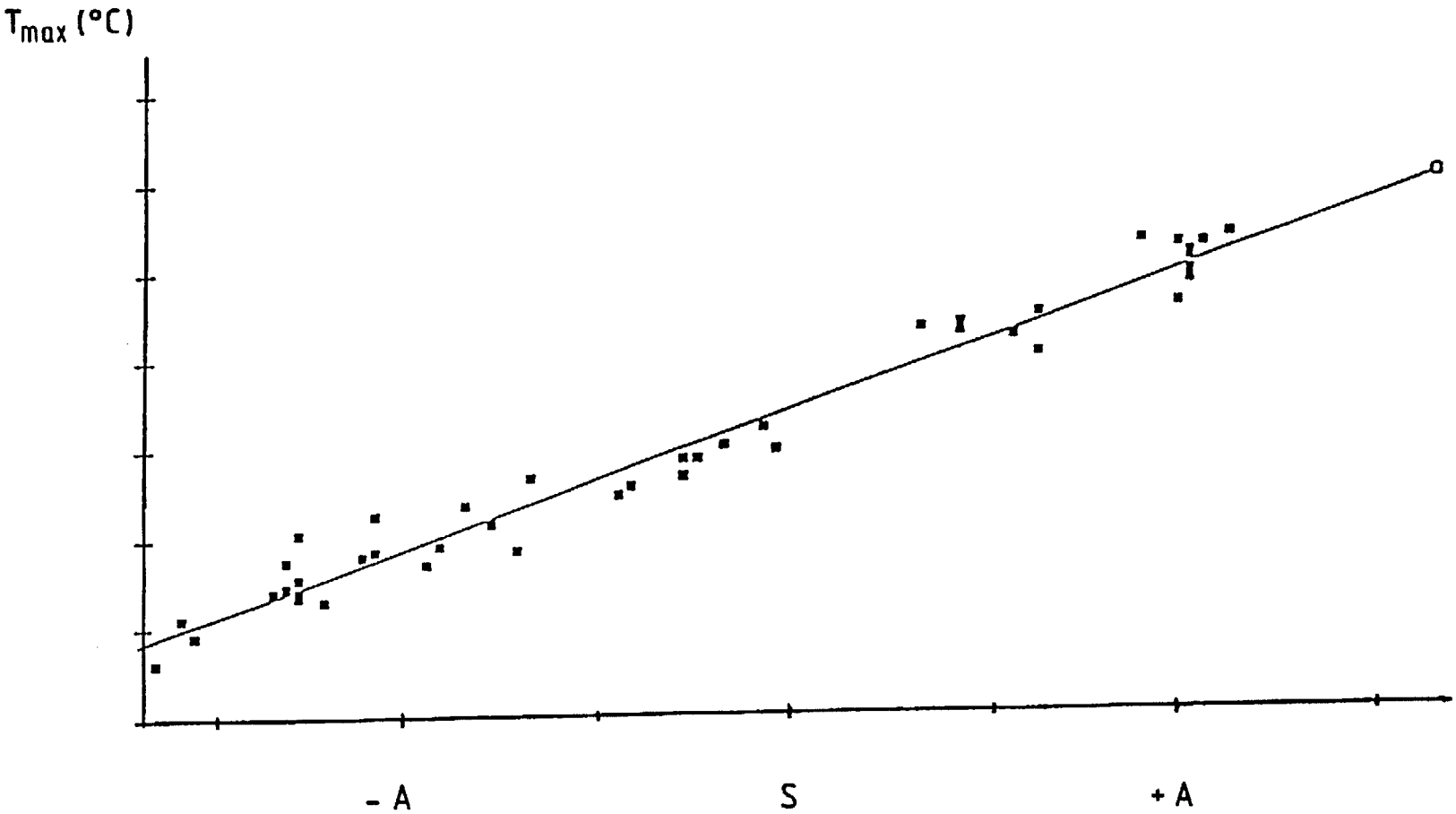
FIG. 2 shows the essentially linear relationship between a substrate surface temperature and the transferred layer mass, again in the example of a plasma-spraying method.

This relationship is illustrated in FIG. 2, which shows the dependency of the transferred layer mass on the maximum surface temperature on an oxygen sensor when the sensor is coated with spinel. The porous spinel layer serves as a protection and diffusion layer above the sensor electrode. During coating, the finger-shaped sensors ("stones") rotate about their longitudinal axis, for example at 100 to 200 U/minute. A plasma stream that includes the spinel particles travels once from the tip to the base and back, parallel to the axis of rotation, within a period of, for example, 10 to 20 seconds. The infrared pyrometer is directed at a circular measuring spot that has a 5 mm diameter and is located near the sensor tip, above the electrode zone, at an angle of 90° (straight up) or 270° (straight down) with respect to the direction of the plasma beam. Therefore, in the first case, the sensor has rotated by 90°, and by 270° in the second case, after the plasma beam has passed over the measuring spot. The two straight lines exhibit a difference of about 30° C., corresponding to the cooling after rotation by 180°. If the sensors rotate at, for example, 180 U/minute, this corresponds to a period of 0.16 seconds.

FIG. 2 shows the maximum surface temperature $T_{max}$ versus the deviation A of the mass transfer from the nominal value S. This is the temperature exhibited by the measuring spot after the plasma beam has passed over it a second time. In principle, the lower temperature that can be measured after the first time the measuring spot has been passed over is also suitable for monitoring and control, although the scattering of the measured values is less at the maximum surface temperature.

The substrate surface temperature—in the case of oxygen sensor coating, advisably the maximum surface temperature defined as described above—is now used, in a way that is familiar to a person skilled in the art of measuring and control technology, for monitoring and controlling the plasma-spraying method. In the case of oxygen sensor coating, the first step is to determine method parameters with which sensors are obtained that, in testing with gases of defined composition and therefore a specific lambda value, sufficiently display the lambda value, that is, they have an optimum coating. The maximum surface temperature determined in production of these sensors serves as a characteristic variable for the desired optimally-transferred layer mass (and therefore for the optimum average layer thickness) and is preset as a nominal value.

As soon as a measurement of the nominal value indicates a deviation from the predetermined nominal value, the control intervenes by making appropriate changes to at least one of the parameters significant for the transferred layer mass or the layer thickness. For example, the mass flow of the coating material particles in the plasma stream can be changed through variation of the quantity of the coating material supplied within the time unit, and/or the gas volume flow. Another control option is to change the relative speed at which the plasma stream and the part to be coated move with respect to one another. In the case of oxygen sensors, the period of time in which the plasma beam travels back and forth can be changed. Furthermore, it is possible to change the number of individual spray passes that together lead to the desired transferred layer mass and therefore the desired layer thickness. It is, moreover, possible to make appropriate changes to a plurality of parameters simultaneously. In the case of the oxygen sensors, for example, the quantity of the coating material supplied within the time unit could be reduced and the time period during which the plasma beam travels back and forth could be shortened if a maximum surface temperature indicates that an excessive amount of layer mass is being transferred. Which parameter (s) will be affected by the control depends on the respective coating job, as well as on which action appears to be optimal regarding economic and technical aspects related to the method and production. In the case of the oxygen sensors, it is advisable to vary only the quantity of coating material supplied within the time unit in order to correct deviations from the nominal value of the transferred layer mass.

An essential feature of the present invention is that a substrate surface temperature is used as a characteristic variable for monitoring and controlling thermal spraying methods. The above-mentioned maximum surface temperature is particularly suited for coating oxygen sensors. With the use of the surface temperature as a characteristic variable, deviations of the transferred layer mass of only about ±5% from the nominal value can be achieved. Accordingly, the scattering control state of the sensors, that is, of the deviations in measuring precision of the lambda value, is low.

Instead of the individual value of the maximum surface temperature, an average value, for example from 4, 6 or 8 measurements, can also be used as a characteristic variable for monitoring and controlling the spraying process. It has been seen that the average value of the transferred layer masses only deviates from the nominal value by approximately ±2%. In contrast, in a mode of operation that does not involve control, the average value of the transferred layer masses can drift by ±10% or more over time. The scatter of the individual transferred layer masses, however, cannot be reduced by control that employs an average value of the maximum surface temperature. As with control, the scatter is up to approximately ±5% above the individual maximum peak surface temperature.

In another embodiment of the invention, the difference between two surface temperatures is used in place of one surface temperature as a characteristic variable for monitoring and controlling thermal spraying methods. In this instance, the difference between the surface temperatures at a specific position on the substrate directly before and directly after a spraying process or spray pass is used. This embodiment is particularly suited for thermal spraying methods for coating parts having large surfaces.

If it is intended to change the spraying parameters—in a plasma-spraying method, for example flow intensity, voltage and/or gas volume flow—and an alteration of the substrate in coating of oxygen sensors, for example, the sensor type—the control must be reset. It is advisable also to monitor the selected values for flow intensity, voltage and gas volume flow and, when a critical change is made, a warning is issued and/or the system is shut down. If the flow intensity for controlling the porosity of the sprayed layer is low, that is, it is changed by a maximum of approximately ±10A, a slight change in the nominal value will suffice instead of resetting the control.

It will be understood that the above description of the present invention is susceptible to various modifications, changes and adaptations, and the same are intended to be comprehended within the meaning and range of equivalents of the appended claims.

What is claimed is:

1. A method of monitoring and controlling thermal spraying methods for coating a surface of a substrate by heated, inorganic particles as a coating material, including the steps of: coating the surface of the substrate by a spraying method with a stream of the heated, inorganic particles; measuring a substrate surface temperature as a characteristic variable for a transferred layer mass or layer thickness during the spraying method; comparing the measured substrate surface temperature with a nominal value; and if deviations from the nominal value occur, changing, for control purposes, at least one method parameter, which parameter affects the layer mass or layer thickness and which parameter is selected from the group consisting of a particle concentration in the stream of heated inorganic particles, a relative speed at which the stream of heated particles and the susbstrate to be coated move with respect to one another, and a number of coating passes leading to a desired transferred layer mass or desired layer thickness, to reduce the deviations.

2. A method as defined in claim 1, wherein the thermal spraying method is a plasma-spraying method.

3. A method as defined in claim 1, wherein the thermal spraying method is a flame-spraying method.

4. A method as defined in claim 1, wherein the thermal spraying method is an electric-arc spraying method.

5. A method as defined in claim 1, wherein the method parameter used for control purposes is the particle concentration in the stream of heated particles of the coating material.

6. A method as defined in claim 1, wherein the method parameter used for control purposes is the relative speed at which the stream of heated particles of coating material and the substrate to be coated move with respect to one another.

7. A method as defined in claim 1, wherein the method parameter used for control purposes is the number of coating passes leading to the desired transferred layer mass or desired layer thickness.

8. A method as defined in claim 1, wherein the temperature used for the comparison is a maximum substrate surface temperature measured during the coating step.

9. A method as defined in claim 1, wherein the temperature used for the comparison is an average substrate surface temperature measured during the coating step.

10. A method as defined in claim 1, comprising measuring, for control purposes, a difference between surface temperatures at a specific position on the substrate directly before and directly after a spraying process or spray pass.

11. A method as defined in claim 1, wherein the step of measuring includes periodically measuring the substrate surface temperature at a single specified position on the substrate surface during the spraying method.

12. A method of monitoring and controlling a thermal spraying method used to coat parts in mass production, with the method including the steps of: coating a surface of the part by a spraying method with a stream of the heated, inorganic particles; measuring a surface temperature of the part as a characteristic variable for a transferred layer mass or layer thickness during the spraying method; comparing the measured surface temperature with a nominal value; if deviations from the nominal value occur, changing, for control purposes, at least one method parameter that affects the layer mass or layer thickness to reduce the deviations; and implementing the step of changing at least one method parameter to control the transferred layer mass or layer thickness immediately after the part having the deviating surface temperature has been identified.

13. A method as defined in claim 12, wherein the parts to be coated are oxygen sensors for internal combustion engines.

14. A method as defined in claim 12, wherein the step of measuring includes periodically measuring the surface temperature at a single specified position on the surface of the part during the spraying method.

* * * * *